US009791175B2

(12) United States Patent
Senf, Jr.

(10) Patent No.: US 9,791,175 B2
(45) Date of Patent: Oct. 17, 2017

(54) INTELLIGENT COMPRESSOR FLOODED START MANAGEMENT

(71) Applicant: Carrier Corporation, Farmington, CT (US)

(72) Inventor: Raymond L Senf, Jr., Central Square, NY (US)

(73) Assignee: CARRIER CORPORATION, Farmington, CT (US)

( * ) Notice: Subject to any disclaimer, the term of this patent is extended or adjusted under 35 U.S.C. 154(b) by 504 days.

(21) Appl. No.: 14/371,087

(22) PCT Filed: Mar. 5, 2013

(86) PCT No.: PCT/US2013/029077

§ 371 (c)(1),
(2) Date: Jul. 8, 2014

(87) PCT Pub. No.: WO2013/134240

PCT Pub. Date: Sep. 12, 2013

(65) Prior Publication Data

US 2015/0007597 A1 Jan. 8, 2015

Related U.S. Application Data

(60) Provisional application No. 61/608,893, filed on Mar. 9, 2012.

(51) Int. Cl.

| | |
|---|---|
| ***F25B 41/04*** | (2006.01) |
| ***F25B 49/00*** | (2006.01) |
| ***F25B 43/02*** | (2006.01) |
| ***G05D 23/19*** | (2006.01) |
| ***G08B 17/00*** | (2006.01) |
| ***F25B 1/00*** | (2006.01) |

(Continued)

(52) U.S. Cl.
CPC ..... *F25B 1/005* (2013.01); *F25B 1/04* (2013.01); *F25B 49/022* (2013.01);
(Continued)

(58) Field of Classification Search
CPC ..... F25D 1/04; F25D 2500/26; F25D 2700/1933; F25D 2700/21151; F25D 27/00; F25D 49/022; F25D 11/003
(Continued)

(56) References Cited

U.S. PATENT DOCUMENTS 3,037,362 A 6/1958 Tilney et al.
3,093,976 A 4/1962 Walcutt
(Continued)

FOREIGN PATENT DOCUMENTS

EP 0680129 A1 11/1995
EP 0797000 A1 9/1997
(Continued)

OTHER PUBLICATIONS

Emerson Copeland Application Engineering Bulletin.*
(Continued)

*Primary Examiner* — Henry Crenshaw
(74) *Attorney, Agent, or Firm* — Cantor Colburn LLP

(57) ABSTRACT

A method is provided for managing a flooded start of a compressor in a vapor compression system. Following an initial bump start, a determination is made as to whether working fluid in a liquid state remains in the sump of the compressor. If working fluid in a liquid state remains in the compressor sump, an additional bump start of the compressor is completed, followed by another determination as to whether working fluid in a liquid state still remains in the compressor sump. If working fluid in a liquid state remains in the compressor sump, another bump start of the compressor is initiated and the sequence repeated until no working fluid in the liquid state remains in the compressor sump. A normal start of the compressor may be initiated after determining no working fluid in the liquid state remains in the compressor sump.

8 Claims, 2 Drawing Sheets

(51) Int. Cl.

| | |
|---|---|
| ***F25B 1/04*** | (2006.01) |
| ***F25B 49/02*** | (2006.01) |
| ***F25D 11/00*** | (2006.01) |
| *F25B 27/00* | (2006.01) |
| *F25B 40/00* | (2006.01) |

(52) U.S. Cl.
CPC ..... *F25D 11/003* (2013.01); *F25B 27/00* (2013.01); *F25B 40/00* (2013.01); *F25B 2327/001* (2013.01); *F25B 2500/26* (2013.01); *F25B 2600/01* (2013.01); *F25B 2600/0251* (2013.01); *F25B 2700/1933* (2013.01); *F25B 2700/2106* (2013.01); *F25B 2700/21151* (2013.01)

(58) Field of Classification Search
USPC ..... 62/472, 217, 228.3, 227; 236/78 D; 340/589
See application file for complete search history.

(56) References Cited

U.S. PATENT DOCUMENTS

| | | | | |
|---|---|---|---|---|
| 3,636,723 | A * | 1/1972 | Kramer | F25B 43/006 62/197 |
| 3,698,839 | A | 10/1972 | Distefano | |
| 3,769,809 | A * | 11/1973 | Robinson | F25C 5/187 62/137 |
| 3,873,239 | A | 3/1975 | Jamieson | |
| 3,890,063 | A | 6/1975 | Spafford | |
| 4,090,371 | A | 5/1978 | Keane | |
| 4,193,270 | A | 3/1980 | Scott | |
| 4,356,703 | A | 11/1982 | Vogel | |
| 4,381,650 | A | 5/1983 | Mount | |
| 4,651,535 | A | 3/1987 | Alsenz | |
| 4,686,835 | A | 8/1987 | Alsenz | |
| 4,974,420 | A | 12/1990 | Kramer | |
| 5,035,119 | A | 7/1991 | Alsenz | |
| 5,076,066 | A | 12/1991 | Bottum | |
| 5,077,983 | A | 1/1992 | Dudley | |
| 5,140,826 | A * | 8/1992 | Hanson | B60H 1/00014 123/142.5 R |
| 5,184,473 | A * | 2/1993 | Day | F25B 5/04 62/199 |
| 5,209,076 | A | 5/1993 | Kauffman et al. | |
| 5,247,804 | A | 9/1993 | Paige et al. | |
| 5,395,214 | A | 3/1995 | Kawahara et al. | |
| 5,640,854 | A | 6/1997 | Fogt et al. | |
| 5,666,815 | A | 9/1997 | Aloise | |
| 5,803,716 | A | 9/1998 | Wallis et al. | |
| 5,820,352 | A | 10/1998 | Gunn et al. | |
| 5,967,757 | A | 10/1999 | Gunn et al. | |
| 6,089,034 | A * | 7/2000 | Lake | B60H 1/00907 62/204 |
| 6,244,824 | B1 | 6/2001 | Centers et al. | |
| 6,279,331 | B1 | 8/2001 | Hirota | |
| 6,298,673 | B1 | 10/2001 | Fung et al. | |
| 6,311,512 | B1 | 11/2001 | Fung et al. | |
| 6,450,771 | B1 | 9/2002 | Centers et al. | |
| 6,539,734 | B1 * | 4/2003 | Weyna | F04B 39/0207 62/126 |
| 6,578,373 | B1 * | 6/2003 | Barbier | F25B 49/005 236/78 D |
| 6,886,354 | B2 | 5/2005 | Dudley | |
| 6,904,759 | B2 | 6/2005 | Shoulders | |
| 6,973,794 | B2 * | 12/2005 | Street | F25B 49/02 62/129 |
| 6,993,918 | B1 | 2/2006 | Cowans | |
| 7,047,753 | B2 * | 5/2006 | Street | F25B 49/02 62/126 |
| 7,143,594 | B2 | 12/2006 | Ludwig et al. | |
| 7,231,773 | B2 | 6/2007 | Crane et al. | |
| 7,290,990 | B2 | 11/2007 | Lifson | |
| 7,421,854 | B2 | 9/2008 | Shaffer et al. | |
| 7,426,837 | B2 | 9/2008 | Hayashi et al. | |
| 7,540,163 | B2 | 6/2009 | Lifson et al. | |
| 7,594,407 | B2 | 9/2009 | Singh et al. | |
| 7,628,028 | B2 | 12/2009 | Tolbert, Jr. et al. | |
| 7,958,737 | B2 | 6/2011 | Lifson et al. | |
| 7,975,495 | B2 | 7/2011 | Voorhis et al. | |
| 8,109,102 | B2 | 2/2012 | Lifson et al. | |
| 2003/0077179 | A1 | 4/2003 | Collins et al. | |
| 2004/0194485 | A1 * | 10/2004 | Dudley | F04B 39/0207 62/193 |
| 2005/0235664 | A1 * | 10/2005 | Pham | F04C 28/00 62/126 |
| 2006/0037336 | A1 * | 2/2006 | Bush | F25B 41/043 62/197 |
| 2007/0032909 | A1 | 2/2007 | Tolbert et al. | |
| 2007/0151265 | A1 | 7/2007 | Crane et al. | |
| 2007/0157649 | A1 | 7/2007 | Pedersen et al. | |
| 2007/0196418 | A1 | 8/2007 | Lewis et al. | |
| 2009/0013701 | A1 | 1/2009 | Lifson et al. | |
| 2009/0090117 | A1 | 4/2009 | McSweeney | |
| 2009/0092501 | A1 | 4/2009 | Seibel | |
| 2009/0299530 | A1 | 12/2009 | Burnham et al. | |
| 2009/0299534 | A1 | 12/2009 | Ludwig | |
| 2009/0324427 | A1 | 12/2009 | Tolbert, Jr. et al. | |
| 2010/0011788 | A1 | 1/2010 | Lifson et al. | |
| 2010/0178175 | A1 | 7/2010 | Koyama | |
| 2010/0278660 | A1 | 11/2010 | Burchill et al. | |
| 2011/0088411 | A1 | 4/2011 | Steele et al. | |
| 2011/0209485 | A1 | 9/2011 | Lifson et al. | |

FOREIGN PATENT DOCUMENTS

| | | | |
|---|---|---|---|
| JP | 6147122 | A | 5/1994 |
| JP | 10227533 | A | 8/1998 |
| JP | 2007298254 | A | 11/2007 |
| JP | 2008190737 | A | 8/2008 |
| WO | 03036090 | A1 | 5/2003 |
| WO | 2004092686 | A2 | 10/2004 |
| WO | 2005066557 | A1 | 7/2005 |
| WO | 2006088717 | A2 | 8/2006 |
| WO | 2007019282 | A2 | 2/2007 |
| WO | 2007106116 | A1 | 9/2007 |
| WO | 2008033123 | A1 | 3/2008 |
| WO | 2008140516 | A1 | 11/2008 |
| WO | 2009096923 | A1 | 8/2009 |

OTHER PUBLICATIONS

Chinese Office Action and Search Report for CN 201380006139.0, dated Dec. 4, 2015, 7 pages.

Copeland, "A/C Scroll Compressors ZR 90 K4* ZR 300 KC* Application Guideline", accessed Aug. 12, 2016 at http://www.google.com/url? sa=t&rct=j&q=&esrc=s&source=web&cd=1&ved=0ahUKEwjyjbzMy7zOAhVkJcAKHUoHAIEQFggcMAA&url=http%3A%2F%2Fwww.totaline.com.tr%2Fpdf%2F61%2FCOPELAND%2520ZR90-300. pdf&usg=AFQjCNGU_LbsUJ6xVDp4J4ZVyWCVzWNY7w&bvm=bv.129422649,d.eWE, 21 pages.

Emerson Climate Technologies, "ZR84KC(E) to ZR144KC(E) and ZP90KCE to ZP182KCE Copeland SCROLLTM Compressors", Application Engineering Bulletin, 1997-2005 Copeland Corporation, 15 pages.

Singapore Office Action for application SG 11201403966W, dated Aug. 4, 2015, 9 pages.

PCT International Preliminary Report on Patentability and Written Opinion of the International Searching Authority for International Application No. PCT/US2013/029077, Sep. 18, 2014, 11 pages PCT International Search Report and the Written Opinion of the International Searching Authority, or the Declaration for International Application No. PCT/US2013/029077, Jul. 4, 2013, 16 pages.

* cited by examiner

INTELLIGENT COMPRESSOR FLOODED START MANAGEMENT

BACKGROUND OF THE INVENTION

This disclosure relates generally to vapor compression systems and, more particularly, to flooded start management of a compressor in a refrigerant vapor compression system.

Conventional vapor compression systems typically include a compressor, a heat rejection heat exchanger, a heat absorption heat exchanger, and expansion device disposed upstream with respect to working fluid flow of the heat absorption heat exchanger and downstream of the heat rejection heat exchanger. These basic system components are interconnected by working fluid lines in a closed circuit, arranged in accord with known vapor compression cycles. Vapor compression systems charged with a refrigerant as the working fluid are commonly known as refrigerant vapor compression systems.

Refrigerant vapor compression systems are commonly used for conditioning air to be supplied to a climate controlled comfort zone within a residence, office building, hospital, school, restaurant or other facility. Refrigerant vapor compression system are also commonly used for refrigerating air supplied to display cases, merchandisers, freezer cabinets, cold rooms or other perishable/frozen product storage areas in commercial establishments. Refrigerant vapor compression systems are also commonly used in transport refrigeration systems for refrigerating air supplied to a temperature controlled cargo space of a truck, trailer, container or the like for transporting perishable/frozen items by truck, rail, ship or intermodal. Refrigerant vapor compression systems used in connection with transport refrigeration systems are generally subject to more stringent operating conditions than in air conditioning or commercial refrigeration applications due to the wide range of operating load conditions and the wide range of outdoor ambient conditions over which the refrigerant vapor compression system must operate to maintain product within the cargo space at a desired temperature.

In all vapor compression systems, the compressor is designed for compressing working fluid received at the suction inlet of the compressor in vapor state at a relatively lower pressure. The working fluid vapor is compressed and discharged from the compressor as a relatively higher pressure vapor. However, if the vapor compression system is started after an extended period time in during which the compressor has not been operating, working fluid trapped in the compressor when the system was shut down, as well as working fluid that may have migrated into the compressor during the extended period of shutdown, will accumulate in the compressor sump in a liquid state. Typically, a flooded refrigerant compressor may have from as little as one pound of refrigerant up to ten pounds of refrigerant accumulated in the compressor sump. Consequently, upon start-up of the compressor after the vapor compression system has been shut down for an extended period of time, liquid working accumulate within the sump can be drawn into the compression mechanism of the compressor. A start of the compressor with liquid working accumulated in the compressor sump is commonly referred to a "flooded start". A flooded start of the compressor is undesirable for several reasons, including the potential for permanent damage to the compression elements. Also, flooded starts are noisy.

SUMMARY OF THE INVENTION

In an aspect, a method is provided for managing a flooded start of a compressor in a vapor compression system, including; initiating an initial bump start of the compressor; terminating the initial bump start; determining whether a working fluid in a liquid state remains in a sump of the compressor; and if working fluid in a liquid state remains in the compressor sump, initiating an additional bump start of the compressor. The method further includes: following termination of the additional bump start of the compressor, determining whether working fluid in a liquid state still remains in the compressor sump; if working fluid in a liquid state remains in the compressor sump, initiating another additional bump start of the compressor; and repeating the aforesaid sequence until no working fluid in the liquid state remains in the compressor sump. A normal start of the compressor may be initiated after determining no working fluid in the liquid state remains in the compressor sump.

In an aspect, a method is provided for managing a flooded start of a compressor in a refrigerant vapor compression system, that includes: reading an initial saturated suction pressure prior to initiating the flooded start of the compressor; initiating an initial bump start of a potential sequence of bump starts of the compressor; terminating the initial bump start of the compressor; upon termination of the initial bump start, pausing for a preset period of time; upon lapse of the preset period of time, reading the current saturation suction pressure; comparing the current saturation suction pressure to the initial saturation suction pressure; and if the current saturation suction pressure is not less than the initial saturation suction pressure by an amount greater than a preselected pressure differential, continuing the sequence of bump starts and comparing the then current saturation suction pressure to the initial saturation suction pressure until the then current saturation suction pressure is less than the initial saturation suction pressure by an amount greater than the preselected pressure differential. The method may further include: reading an ambient air temperature; if the then current saturation suction pressure is less than the initial saturation suction pressure by an amount greater than the preselected pressure differential, calculating a then current saturated suction temperature based on the then current saturation suction pressure; comparing the calculated current saturated suction temperature to the ambient air temperature; and if the calculated current saturated suction temperature is less than the ambient air temperature by an amount greater than a preselected temperature differential, discontinuing the sequence of bump starts and performing a normal start of the compressor.

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
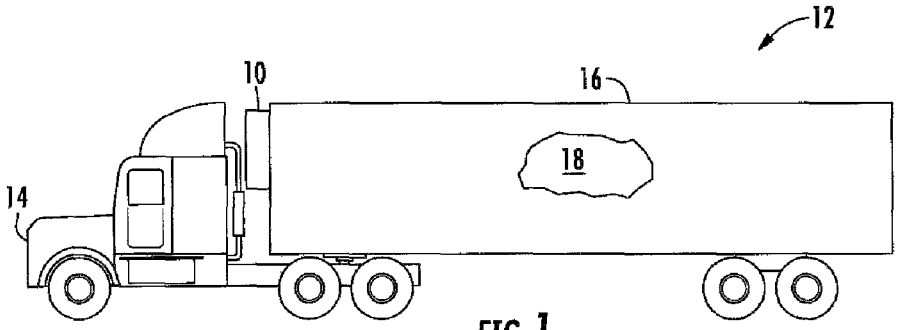
FIG. 1 is a view of a refrigerated trailer equipped with a transport refrigeration system.

Referring initially to FIG. 1, the method for intelligent adaptive management of a flooded start of a compressor of a vapor compression system disclosed herein will be described in application to a refrigeration vapor compressor of a transport refrigeration system 10 mounted to a front wall of a trailer 12 pulled by a tractor 14 for transporting perishable goods, such as fresh or frozen products. The exemplary trailer 12 depicted in FIG. 1 includes a cargo container/box 16 defining an interior cargo space 18 wherein the perishable goods are stowed for transport. The transport refrigeration system 10 is operative to climate control the atmosphere within the interior cargo space 18 of the cargo container/box 16 of the trailer 12. It is to be understood that the method disclosed herein may be applied not only to refrigeration systems associated with trailers, but also to refrigeration systems applied to refrigerated trucks, to intermodal containers.

Further, it is to be understood that the method for intelligent adaptive management of a flooded start of a compressor of a vapor compression system disclosed herein may also be applied to refrigerant vapor compression systems in conditioning air to be supplied to a climate controlled comfort zone within a residence, office building, hospital, school, restaurant or other facility, or in refrigerating air supplied to display cases, merchandisers, freezer cabinets, cold rooms or other perishable/frozen product storage areas in commercial establishments. In refrigerant vapor compression systems, the working fluid is a refrigerant, such as for example but not limited to, hydrochlorofluorocarbon refrigerants, hdyrofluorocarbon refrigerants, carbon dioxide and refrigerant mixtures containing carbon dioxide. However, the method for intelligent adaptive management of a flooded start of a compressor of a vapor compression system disclosed herein may also be applied to vapor compression systems used in non-refrigeration applications and charged with working fluids that are not refrigerants per se.

Figure 2:
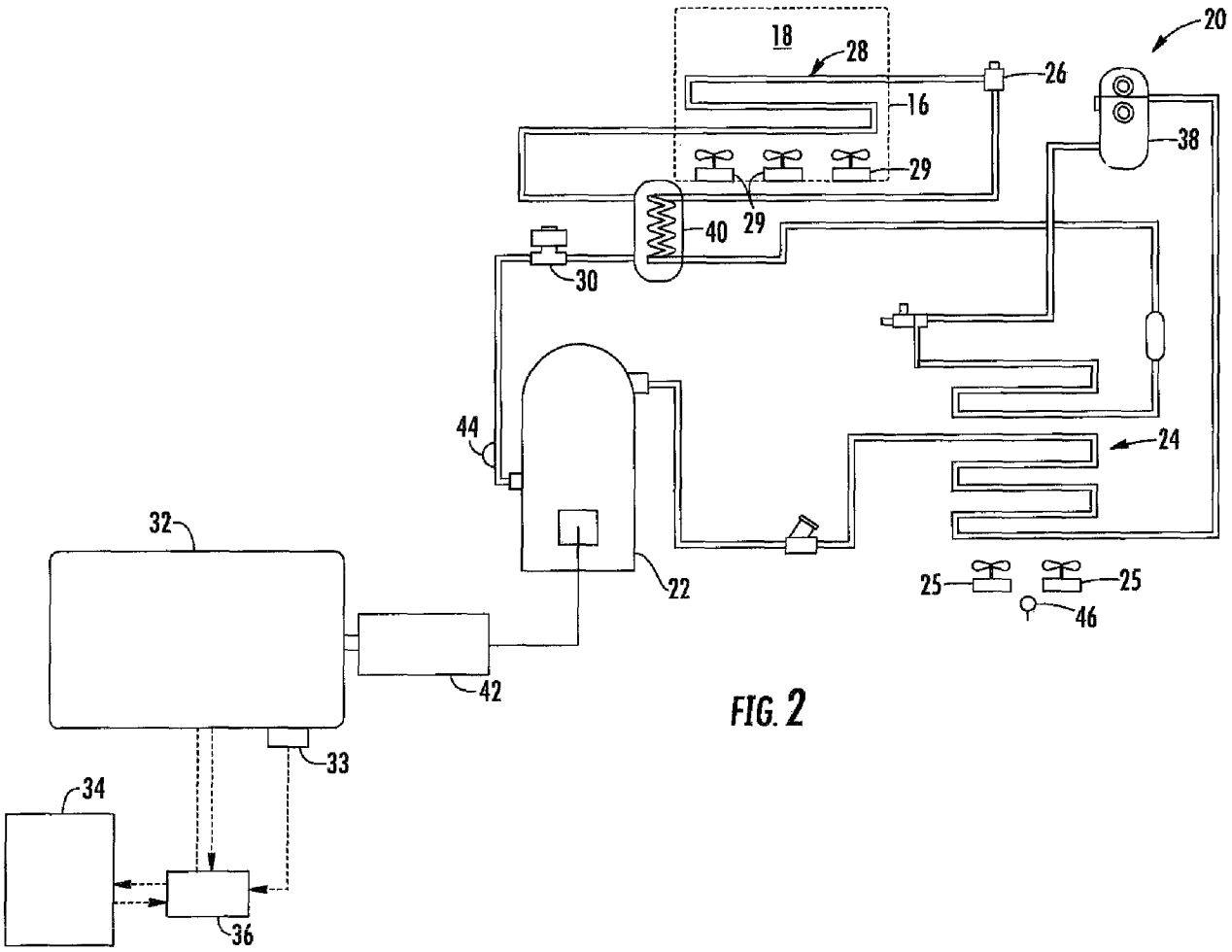
FIG. 2 is a schematic diagram of an embodiment of a transport refrigeration system having a scroll compressor is driven by a motor.

Referring to FIG. 2, there is depicted an embodiment of a transport refrigeration system 10 for cooling the atmosphere within the interior space 18 of the cargo box 16 of the trailer 12 or the cargo box of a truck, container, intermodal container or similar cargo transport unit. The transport refrigeration system 10 includes a refrigerant vapor compression system 20, also referred to herein as transport refrigeration unit 20, including a compressor 22, a refrigerant heat rejection heat exchanger 24 (shown as a condenser in the depicted embodiments) with its associated fan(s) 25, an expansion device 26, a refrigerant evaporator heat exchanger 28 with its associated fan(s) 29, and a suction modulation valve 30 connected in a closed loop refrigerant circuit and arranged in a conventional refrigeration cycle. The transport refrigeration system 10 further includes a diesel engine 32 equipped with an engine throttle position sensor 33, an electronic refrigeration unit controller 34 and an electronic engine controller 36. The transport refrigeration system 10 is mounted as in conventional practice to an exterior wall of the truck, trailer or container with the compressor 22 and the condenser heat exchanger 24 with its associated condenser fan(s) 25, and diesel engine 32 disposed externally of the refrigerated cargo box 16.

As in conventional practice, when the transport refrigerant unit 20 is operating in a cooling mode, low temperature, low pressure refrigerant vapor is compressed by the compressor 22 to a high pressure, high temperature refrigerant vapor and passed from the discharge outlet of the compressor 14 to circulate through the refrigerant circuit to return to the suction inlet of the compressor 22. The high temperature, high pressure refrigerant vapor passes into and through the heat exchange tube coil or tube bank of the condenser heat exchanger 24, wherein the refrigerant vapor condenses to a liquid, thence through the receiver 38, which provides storage for excess liquid refrigerant, and thence through the subcooler coil of the condenser heat exchanger 24. The subcooled liquid refrigerant then passes through a first refrigerant pass of the refrigerant-to-refrigerant heat exchanger 40, and thence traverses the expansion device 26 before passing through the evaporator heat exchanger 28. In traversing the expansion device 26, which may be an electronic expansion valve ("EXV") as depicted in FIG. 2, or a mechanical thermostatic expansion valve ("TXV"), the liquid refrigerant is expanded to a lower temperature and lower pressure prior to passing to the evaporator heat exchanger 28.

In flowing through the heat exchange tube coil or tube bank of the evaporator heat exchanger 28, the refrigerant evaporates, and is typically superheated, as it passes in heat exchange relationship return air drawn from the cargo space 18 passing through the airside pass of the evaporator heat exchanger 28. The refrigerant vapor thence traverses a second refrigerant pass of the refrigerant-to-refrigerant heat exchanger 40 in heat exchange relationship with the liquid refrigerant passing through the first refrigerant pass thereof. Before entering the suction inlet of the compressor 22, the refrigerant vapor passes through the suction modulation valve 30 disposed downstream with respect to refrigerant flow of the refrigerant-to-refrigerant heat exchanger 40 and upstream with respect to refrigerant flow of the suction inlet of the compressor 22. The refrigeration unit controller 34 controls operation of the suction modulation valve 30 and selectively modulates the open flow area through the suction modulation valve 30 so as to regulate the flow of refrigerant passing through the suction modulation valve to the suction inlet of the compressor 22. By selectively reducing the open flow area through the suction modulation valve 30, the refrigeration unit controller 30 can selectively restrict the flow of refrigerant vapor supplied to the compressor 22, thereby reducing the capacity output of the transport refrigeration unit 20 and in turn reducing the power demand imposed on the engine 32.

Air drawn from within the cargo box 16 by the evaporator fan(s) 29 associated with the evaporator heat exchanger 28, is passed over the external heat transfer surface of the heat exchange tube coil or tube bank of the evaporator heat exchanger 28 and circulated back into the interior space 18 of the cargo box 16. The air drawn from the cargo box is referred to as "return air" and the air circulated back to the cargo box is referred to as "supply air". It is to be understood that the term "air' as used herein includes mixtures of air and other gases, such as for example, but not limited to nitrogen or carbon dioxide, sometimes introduced into a refrigerated cargo box for transport of perishable product such as produce.

In the embodiment of the transport refrigeration system depicted in FIG. 2, the compressor 22 comprises a semi-hermetic scroll compressor having an internal electric drive motor (not shown) and a compression mechanism (not shown) having an orbital scroll mounted on a drive shaft driven by the internal electric drive motor that are all sealed within a common housing of the compressor 22. The fueled-fired engine 32 drives an electric generator 42 that generates electrical power for driving the compressor motor that in turn drives the compression mechanism of the compressor 22. The drive shaft of the fueled-fired engine drives the shaft of the generator 42. In this embodiment, the fan(s) 25 and the fan(s) 29 may be driven by electric motors that are supplied with electric current produced by the generator 42. In an electrically powered embodiment of the transport refrigeration system 10, the generator 42 comprises a single on-board engine driven synchronous generator configured to selectively produce at least one AC voltage at one or more frequencies. The compressor 22 may comprise a single stage compressor or a multi-stage compressor or multiple single stage compressors disposed in series refrigerant flow relationship. The refrigerant unit 20 may also include an economizer circuit (not shown), if desired.

Figure 3:
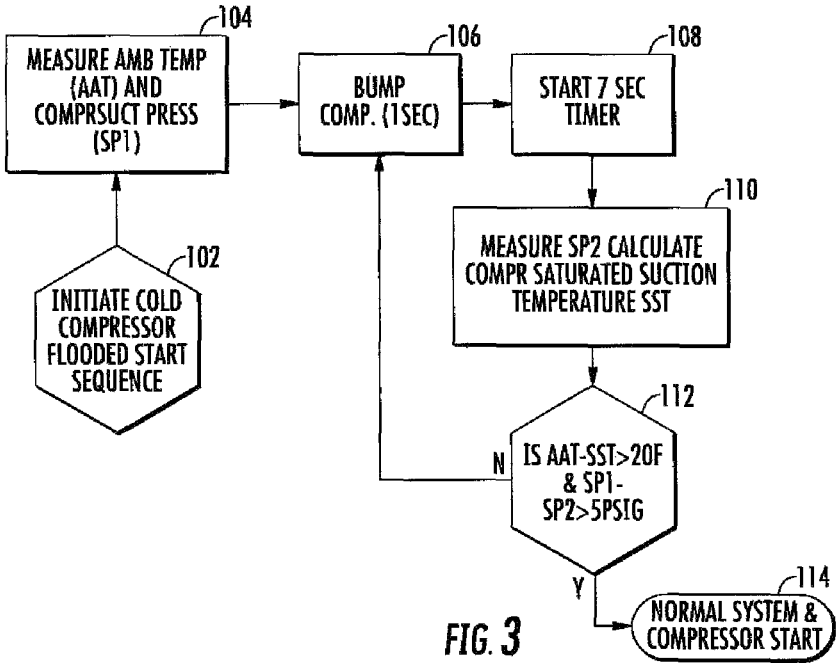
FIG. 3 shows a block diagram illustration of an embodiment of the method as disclosed herein for managing a flooded start of a compressor of a vapor compression system.

In the transport refrigeration system 10, the refrigeration unit controller 34 is configured not only to control operation of the refrigerant vapor compression system 20 based upon consideration of refrigeration load requirements, ambient conditions and various sensed system operating parameters as in conventional practice, but also is configured to manage a flood start of the compressor 22 in accordance with the intelligent adaptive compressor flooded start management logic of the method 100 depicted in FIG. 3. If the refrigeration vapor compression system 20 has been in shut down for an extended period of time, refrigerant in the system will migrate over time to the compressor 22 and accumulate in a liquid state in the sump of the compressor 22.

The refrigeration unit controller 34 will perform a bump start procedure of the compressor 22 before bringing the refrigeration unit 20 on-line if the compressor 22 has been off, i.e. not running, for a continuous extend period, for example a period of twenty-four hours, or if a pressure equalization across the compressor 22 has been detected after an even shorter shutdown period, for example two hours. A pressure equalization across the compressor 22 is considered to exist if the difference been the pressure at the compressor discharge outlet and the pressure at the compressor suction inlet is less than ten psi (pounds per square inch (0.7 kilograms-force per square centimeter).

Referring now to FIG. 3, before bringing the refrigerant vapor compression system 20 on-line after an extend period in shut down or after a pressure equalization condition has been detected as discussed above, refrigeration unit controller 34 will initiate, at block 102, a cold compressor flooded start sequence in accordance with the intelligent adaptive compressor flooded start management logic of the method 100. First, at step 104, the refrigeration unit controller 34 will read the current ambient air temperature, AAT, as sensed by an ambient air temperature sensor, 44, and also read the current compressor suction pressure, SP1, as sensed by a suction pressure sensor 46. As the suction modulation valve 30 was closed upon shutdown of the refrigeration unit 30 and remains closed throughout the bump start sequence, the compressor suction pressure, SP1, sensed by the suction pressure sensor 46, is indicative of the refrigerant saturation pressure within the compressor sump. Next, at block 106, the refrigerant unit controller 34 will "bump start" the compressor 22. As used herein, the term "bump start" or "bump starting" means providing electric current to the drive motor of the compressor 22 for a very short period of time on the order of one second before again terminating the supply of electric current to the compressor drive motor.

As a result of being powered with electric current during the bump start, the compressor drive motor drives the compression mechanism of the compressor 22, which reduces the suction pressure and results in liquid refrigerant in the sump of the compressor 22 being boiled off. Depending upon the amount of liquid refrigerant having accumulated in the compressor sump, only a portion of or the entire accumulated liquid refrigerant in the compressor sump will be boiled off as a result of this first bump start. At termination of the bump start, the refrigeration unit controller 34, at block 108, will allow a preset period of time to lapse, for example in the range of least seven to ten seconds, before again reading the then current compressor suction pressure, SP2, at block 110. This time lapse allows conditions within the compressor sump to reach an equilibrium following termination of the bump start. The current compressor suction pressure, SP2, represents the saturation refrigerant pressure in the compressor sump. At this point, the refrigeration unit controller 34 will also calculate the saturation suction temperature, SST, based on current compressor suction pressure, SP2. The saturation suction temperature, SST, represents the saturation refrigerant temperature At block 112, to determine whether an additional bump start is required to evaporate the liquid refrigerant accumulated in the compressor sump and clear the liquid refrigerant from the compressor sump, the refrigeration unit controller 34 will compare the current compressor suction pressure to the initial compressor suction pressure, SP1, and also compares the calculated saturation suction temperature, SST, to the ambient air temperature, AAT. If the calculated compressor saturated suction temperature, SST, is not less than the ambient air temperature, AAT, by a temperature difference greater than a preselected temperature difference, ΔT, or the current compressor suction pressure, SP2, is not less than the initial compressor suction pressure, SP1, by a pressure difference greater than a preselected pressure difference, ΔP, the refrigeration control unit 34 will return to block 106, initiate another bump start of the compressor 22, and again cycle through blocks 108 to 112.

The refrigeration unit controller 34 will continue to cycle through blocks 106 to 112 of the method 100 until the comparisons at block 112 indicate that all of the liquid refrigerant accumulated within the compressor sump has been boiled off. That is, if at block 112, the calculated compressor saturated suction temperature, SST, is less than the ambient air temperature, AAT, by a temperature difference greater than the preselected temperature difference, ΔT, and the current compressor suction pressure, SP2, is less than the initial compressor suction pressure, SP1, by a pressure difference greater than the preselected pressure difference, ΔP, the refrigerant unit controller 34 will initiate a normal system and compressor to bring the refrigerant vapor compression system 20 on-line knowing that all liquid refrigerant in the compressor sump has been boiled off and only refrigerant vapor is now present.

The preselected temperature difference, ΔT, and the preselected temperature difference, ΔP, should be selected to ensure that once the current suction pressure and saturated suction pressure at the end of a bump start and time pause cycle meet the conditions set forth in block 112, liquid refrigerant cannot be present for the particular refrigerant with which the refrigerant vapor compression system is charged. In an embodiment, for example, the preselected temperature difference, ΔT, may be set at 20 degrees F. (11 degrees C.) and the preselected temperature difference, ΔP, may be set at 5 pounds per square inch gage (0.35 kilogram-force per square centimeter).

Thus, the method for managing a flood start of the compressor in accordance with the intelligent adaptive compressor flooded start management logic of the method 100 depicted in FIG. 3 ensures a reliable flooded start of the compressor without risk of damage from a potentially significant amount of liquid refrigerant being drawn into the compression mechanism of the compressor. Rather than implementing a preset number of bumps on each flooded start, a number typically specified by the compressor manufacturer, the method discussed herein ensures that only the number of bump starts that is actually needed to clear the compressor sump of liquid refrigerant is the number of bumps implemented, no less or no more. The elimination of excessive bump starts over time should contribute to increased compressor reliability, reduced nuisance compressor bump starts when liquid refrigerant is not present, and longer compressor motor life.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. For example, although the compressor 22 is illustrated as a scroll compressor in a transport refrigeration unit, it is to be understood that the method disclosed herein may be applied for managing a flooded start of a scroll compressor in a residential or commercial air conditioning unit or commercial refrigeration unit, for managing a flooded start in other types of compressors. Therefore, it is intended that the present disclosure not be limited to the particular embodiment(s) disclosed as, but that the disclosure will include all embodiments falling within the scope of the appended claims.

I claim:

1. A method for managing a flooded start of a compressor in a refrigerant vapor compression system, comprising:

after shutdown of the compressor and closing of a suction modulation valve at the suction inlet of the compressor, reading an initial saturated suction pressure prior to initiating the flooded start of the compressor;

initiating an initial bump start of a potential sequence of bump starts of the compressor, wherein the initial bump start comprises turning the compressor on for a predetermined period of time;

terminating the initial bump start of the compressor;

upon termination of the initial bump start, pausing for a preset period of time;

upon lapse of the preset period of time, reading the current saturation suction pressure;

comparing the current saturation suction pressure to the initial saturation suction pressure; and if the current saturation suction pressure is not less than the initial saturation suction pressure by an amount greater than a preselected pressure differential, continuing the sequence of bump starts and comparing the then current saturation suction pressure to the initial saturation suction pressure until the then current saturation suction pressure is less than the initial saturation suction pressure by an amount greater than the preselected pressure differential;

when the then current saturation suction pressure is less than the initial saturation suction pressure by an amount greater than the preselected pressure differential, then initiating normal operation of the compressor.

2. The method as set forth in claim 1 wherein the preselected pressure differential is 5 pounds per square inch gauge.

3. A method for managing a flooded start of a compressor in a refrigerant vapor compression system, comprising:

reading an initial saturated suction pressure prior to initiating the flooded start of the compressor;

initiating an initial bump start of a potential sequence of bump starts of the compressor, wherein the initial bump start comprises turning the compressor on for a predetermined period of time;

terminating the initial bump start of the compressor;

upon termination of the initial bump start, pausing for a preset period of time;

upon lapse of the preset period of time, reading the current saturation suction pressure;

comparing the current saturation suction pressure to the initial saturation suction pressure;

if the current saturation suction pressure is not less than the initial saturation suction pressure by an amount greater than a preselected pressure differential, continuing the sequence of bump starts and comparing the then current saturation suction pressure to the initial saturation suction pressure until the then current saturation suction pressure is less than the initial saturation suction pressure by an amount greater than the preselected pressure differential;

reading an ambient air temperature;

if the then current saturation suction pressure is less than the initial saturation suction pressure by an amount greater than the preselected pressure differential, calculating a then current saturated suction temperature based on the then current saturation suction pressure;

comparing the calculated current saturated suction temperature to the ambient air temperature; and if the calculated current saturated suction temperature is less than the ambient air temperature by an amount greater than a preselected temperature differential, discontinuing the sequence of bump starts and performing a normal start of the compressor.

4. The method as set forth in claim 3 wherein the preselected temperature differential is 20 degrees F. (11.1 degrees C.).

5. The method as set forth in claim 1 wherein the compressor comprises a scroll compressor.

6. The method as set forth in claim 1 wherein the refrigerant vapor compression system comprises a transport refrigeration unit for conditioning an atmosphere within a mobile cargo box.

7. The method as set forth in claim 1 wherein the refrigerant vapor compression system comprises a transport refrigeration unit for conditioning an atmosphere within a refrigerated trailer.

8. A method for managing a flooded start of a compressor in a refrigerant vapor compression system, comprising:

reading an initial saturated suction pressure prior to initiating the flooded start of the compressor;

initiating an initial bump start of a potential sequence of bump starts of the compressor, wherein the initial bump start comprises turning the compressor on for a predetermined period of time;

terminating the initial bump start of the compressor;

upon termination of the initial bump start, pausing for a preset period of time;

upon lapse of the preset period of time, reading the current saturation suction pressure;

comparing the current saturation suction pressure to the initial saturation suction pressure;

reading an ambient air temperature;

calculating a current saturated suction temperature based on the then current saturation suction pressure;

continuing the sequence of bump starts in response to a (i) a difference between the then current saturation suction pressure to the initial saturation suction pressure and (ii) a difference between the ambient air temperature and the current saturated suction temperature.

* * * * *